United States Patent [19]

Glesser

[11] 4,347,665

[45] Sep. 7, 1982

[54] POCKET KNIFE

[76] Inventor: Louis S. Glesser, P.O. Box 800, Golden, Colo. 80401

[21] Appl. No.: 262,457

[22] Filed: May 11, 1981

[51] Int. Cl.[3] ..... B26B 1/02

[52] U.S. Cl. ..... 30/161

[58] Field of Search ..... 30/161, 160, 296 A, 30/299, 158

[56] References Cited

U.S. PATENT DOCUMENTS

| | | | |
|---|---|---|---|
| 2,416,277 | 2/1947 | Siegel | 30/158 |
| 2,441,475 | 5/1948 | Di Veglia | 30/299 |
| 2,795,043 | 6/1957 | Fleischer | 30/296 A |
| 3,783,509 | 1/1974 | Lake | 30/161 |
| 4,040,181 | 8/1977 | Johnson | 30/161 |
| 4,268,960 | 5/1981 | Reinschreiber | 30/161 |

*Primary Examiner*—Jimmy C. Peters

*Attorney, Agent, or Firm*—Roger A. Marrs

[57] ABSTRACT

A pocket knife is disclosed herein having a body including a pair of side portions separated by a spacer so as to define a storage cavity for a knife blade. The blade is pivotally carried by its end from a selected end of the body between a stored position and an open or operative position. A releasable lock mechanism is operably carried on the body for retaining the blade in its open position. The blade is provided with a cutting edge along an underside and a cutting edge of shorter length is provided along the top side and a finger depression is formed on the blade adjacent to an enlarged portion for grasping by the thumb of the user for urging the blade from its closed position into its open or operative position. A clip is incorporated into the body for supporting the knife in a pocket, on a belt or the like.

5 Claims, 6 Drawing Figures

FIG. 1
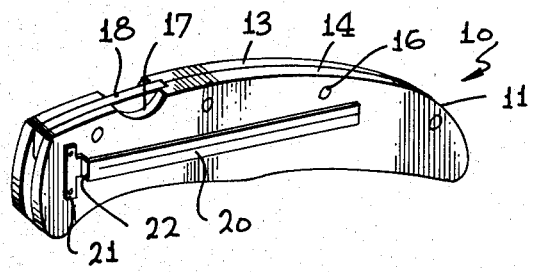
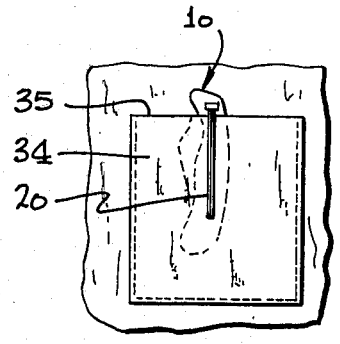
FIG. 6
FIG. 4
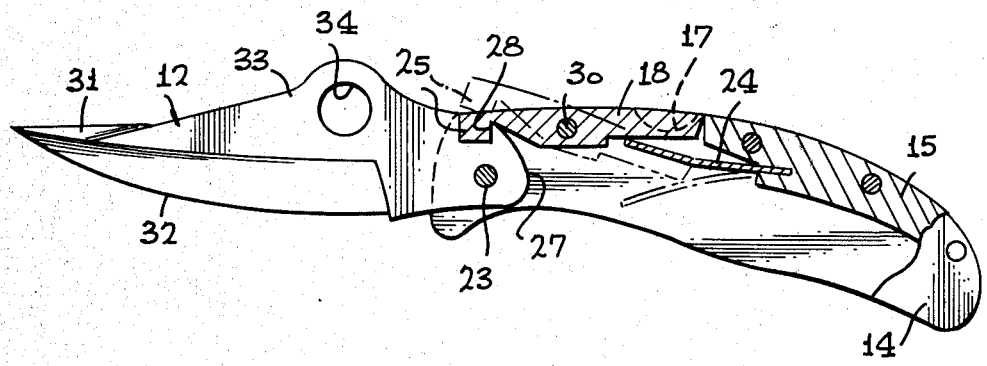
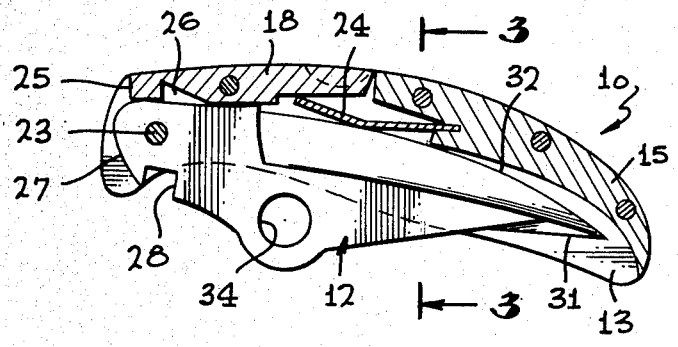
FIG. 2
FIG. 3
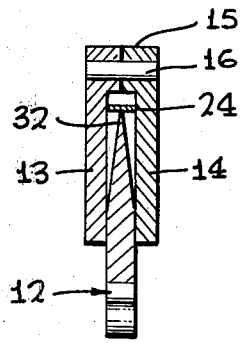
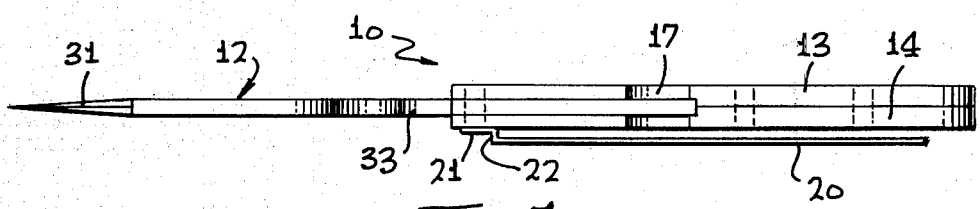
FIG. 5

POCKET KNIFE

BACKGROUND OF THE INVENTION

2. Field of the Invention

The present invention relates to the field of pocket knives and more particularly, to a novel pocket knife that may be readily retained on the edge of a pocket and that may be opened by the use of fingers and thumb on one hand.

2. Brief Description of the Prior Art

In the past, it has been the conventional practice to construct pocket knives so that the knife will reside in the bottom of the pocket without deteriorating the fabric or creating a bulky appearance. Towards this end, knives have been made smaller and of lighter materials and as thin as possible. However, difficulties and problems have been encountered which stem largely from the fact that the knife does rest at the bottom of the pocket and still creates a lump or bulky appearance. Also, even though the knife may have smooth surfaces, a certain amount of wear and fabric deterioration occurs which eventually creates holes in the pocket and loss of pocket contents.

Another problem residing with pocket knives is the inability of conventional knives to be opened through the use of one hand. Such a convenience is important when the other hand is employed to hold or support the item to be worked upon by the knife. For example, the user may hold a package in one hand and desire to open the knife and then use the knife to cut a string or flap on the package. Still other problems are encountered with conventional knives that stem largely from the fact that only one cutting edge is available on the blade for performing useful work and secondly, it is difficult to locate the operable portion of the knife for extracting the blade from the case or handle thereof without actually withdrawing the knife from the pocket and actually looking at or visually inspecting the knife.

Therefore, a longstanding need has existed to provide a novel pocket knife which may be stored in the area of the pocket without causing damage to the fabric and which may readily be opened by one hand of the user and which does not require visual inspection preparatory to opening.

SUMMARY OF THE INVENTION

Accordingly, the above problems and difficulties are obviated by the present invention which provides a novel pocket knife having an elongated body composed of a pair of side portions separated by a central spacer so as to define a storage cavity for enclosing the cutting edge of the knife blade. The knife blade is pivotally carried between the side portions at a selected end thereof so that the blade may be moved alternately between a closed and an open or operative position. Locking means are operatively carried on the body for releasably retaining the blade in its open or operative position. A feature of the invention resides in the fact that the blade includes a cutting edge along an undersurface and a shortened cutting edge along its top surface and the blade further includes an enlarged portion adjacent to the pivot location of the blade with respect to the body that may be engaged by the thumb of the user for exerting sufficient force to actuate the blade from its closed position to its open position. The enlarged portion includes an indentation or depression which may be readily felt by the thumb of the user and at which provides improved leverage for forcing the blade out of the closed position with respect to the body. Clip means are carried on a selected side of the body and is employed for supporting the knife from the edge of a pocket opening, a belt or the like.

Therefore, it is among the primary objects of the present invention to provide a novel pocket knife which may be readily stored from the edge of a pocket defining the opening thereto whereby the knife does not completely bottom in the pocket so as to cause an unsightly appearance.

Another object of the present invention is to provide a pocket knife whereby the blade may be readily opened through the use of one hand without visual inspection by the user.

A further object of the present invention is to provide a novel pocket knife which may be readily carried at the entrance to a pocket by a clip retainer or fastening means so that the knife does not mingle with other articles included in the pocket.

Still a further object of the present invention is to provide a novel pocket knife which includes a blade having upper and lower cutting edges as well as means for permitting the blade to be positioned from its closed position to its opened position by the use of one hand.

A further object of the present invention is to provide a novel pocket knife having a releasable locking means for holding the blade in its opened position with respect to a supporting body.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view illustrating the novel pocket knife of the present invention with its blade in a closed position;

FIG. 2 is a longitudinal cross-sectional view of the knife shown in FIG. 1;

FIG. 3 is a transverse cross-sectional view of the pocket knife shown in FIG. 2 as taken in the direction of arrows 3—3 thereof;

FIG. 4 is a view similar to the view in FIG. 2 illustrating the blade actuated to its opened position and retained therein by a releasable locking mechanism;

FIG. 5 is a top plan view of the pocket knife shown in FIG. 4; and

FIG. 6 is a front elevational view of a shirt or coat pocket illustrating the novel pocket knife mounted along the edge of the pocket leading to the entrance thereof.

DESCRIPTION OF THE PREFERRED EMBODIMENT

Referring to FIG. 1, the novel pocket knife of the present invention is illustrated in the general direction of arrow 10 which includes a body illustrated in general by the numeral 11. The body is intended to be the handle of the knife when a blade 12 has been extended from its closed position, as illustrated to its opened position. The blade 12 is confined in a cavity in its closed position between a pair of elongated side portions 13 and 14 which are separated by a spacer 15 which takes the form of projections integrally formed on the side portions 13 and 14 and which will be described later. The side portions 13 and 14 are held together by means of a plurality of rivets, fasteners or the like such as is illustrated by numeral 16. Also, the side portions 13 and 14 include semi-circular cut-outs indicated by numeral 17 which are coaxially related with respect to each other so as to expose a portion of a locking or retaining mechanism 18. The mechanism 18 is employed for holding the blade in an open or operative position.

FIG. 1 also illustrates a carrying means for the pocket knife 10 which takes the form of a clip 20 attached at a selected end 21 to the end of the knife body 11 adjacent to the pivoted attachment of the blade 12 to the body. The opposite end of the clip 20 is arranged in fixed spaced relationship with respect to the opposing surface of the body side portion 14 so that a gap is created adapted to slidably receiving the thickness of a pocket or belt so that the pocket knife 10 can be supported thereon. A connector portion 22 stands the clip 20 away from the opposing surface of the body side portion 14.

Referring now in detail to FIG. 2, it can be seen that the blade 12 is pivotally carried with respect to the body 11 by means of a pivot pin 23. A leaf spring 24 is arranged so that one end is attached to the spacer portion of the side portion by an interference fit in a corresponding slot so that the spring cantilevers outwardly into the cavity so that its opposite end bears against the underside of the lock mechanism 18. The leaf spring 24 is substantially arcuate in cross-section so as to provide a normal bias against the underside of the lever for the mechanism 18 urging its opposite end illustrated by numeral 25 into engagement with a flat surface 26 on the underside of the knife blade 12. In this fashion, the blade is yieldably held in the closed position by the bias of the leaf spring 24.

Referring to FIG. 4, when it is desired to actuate the knife blade 12 from its closed position in FIG. 2 to the open position in FIG. 4, the blade is rotated against the bias of the spring 24 so that the latch of the mechanism 18 assumes the position in broken lines. Once the blade has been extended to its forward open and operative position, the cam surface indicated by numeral 27 causes the latch of the lever mechanism 18 to drop into a corresponding notch indicated by numeral 28. The bias of the spring 24 now urges the lever of the mechanism to rotate about its central pivot 30 so that the latch 25 is retained within the notch 28. With the knife blade 12 in its operative position, it is noted that a pair of cutting edges 31 and 32 are exposed for use. The cutting edge 32 is elongated substantially extending across the full length of the blade on the underside or edge thereof while its topside or edge is honed to provide a shorter cutting edge 31. Also, it is noted that the top edge marginal region of the blade includes an enlarged portion 33 which is provided with a depression 34. The enlarged portion 33 and the depression 34 are useful to the user in opening the blade from its closed position using one hand. Preferably, the thumb of one hand engages with the depression 34 while the back of the knife adjacent to the separator 15 fits against the palm of the hand. By forcibly urging the thumb outwardly, the blade 12 will follow the movement and open past the spring bias of spring 24. Once the resistance of the spring has been overcome, the blade 12 may readily be carried to its full operative position until stopped by the insertion of the latch 25 into the notch 28.

As shown in FIG. 5, the side portions 13 and 14 come together and are held in this position by the plurality of rivets or fasteners such as represented by numeral 16. However, the adjacent surfaces of a portion of the pieces are reduced in thickness so as to provide a cavity to accommodate the thickness of the knife blade 12, particularly the cutting edges thereof. FIG. 3 shows this construction so that separator 15 is fashioned from the extra thicknesses provided on the side portions 13 and 14 along the edge marginal region thereof.

FIG. 5 also shows the spaced-apart relationship of the clip 20 with respect to the opposing surface of side portion 14. Therefore, the edge of the pocket or belt may be readily accommodated within this space so that the pocket knife can be removably retained thereon.

In FIG. 6, a pocket 34 is illustrated having an edge 35 that has been inserted through the opening between clip 20 and the external surface of side portion 14. The thickness of the material is readily accommodated and the pocket knife downwardly depends on the inside of the pocket while the clip remains outside. In this manner, it can be seen that the knife does not fully enter into the pocket and does not rest against the bottom thereof where it might mix with other contents and which will cause wearing out of the pocket. Also, bulkiness and unsightly lumps are avoided by mounting the pocket knife along the edge leading into the entrance of the pocket.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A pocket knife comprising the combination of:

a handle having opposite, elongated side portions separated by a spacer defining a cavity opening from one side of said handle;

a blade pivotally carried on said handle operable between alternate positions of being stored in said cavity or being open in an operative position as an extension of said handle;

latch means resiliently biasing said blade in either of its stored or operative positions;

said blade having an enlarged portion substantially protruding from its upper top edge and outwardly projecting through said handle cavity opening beyond said handle one side so as to provide an exposed lobe;

said blade enlarged portion outwardly extending from said handle one side when said blade is in its stored position available for engagement by the flesh of the thumb of the user for actuating said blade into its operative position while said handle is held in the same hand of the user;

said enlarged portion on said blade is provided with a lateral facing depression adapted to be physically engaged by the flesh of the user's thumb to effect single-handed pivoting of said blade into its operative position.

2. The invention as defined in claim 1 wherein:

said latch means includes a pivotal lever having a latch at one end selectively engagable with a corresponding notch provided in said blade to releasably retain said blade in said operative position.

3. The invention as defined in claim 2 including:

a leaf spring having one end secured to said handle and projecting into said cavity so that its opposite end bears against the end of said lever opposite to its end carrying said latch.

4. The invention as defined in claim 1 including:

a clip fixed at one of its ends to said handle and disposed in spaced apart relationship so as to slidably receive a portion of a supporting member such as the edge of a pocket, belt or the like.

5. The invention as defined in claim 1 wherein:

said blade further includes a cutting edge along its lower or underside and a second cutting edge along its upper or top edge extending between the tip thereof and said enlarged portion.

* * * * *